US012687367B1

(12) United States Patent
Ferris et al.

(10) Patent No.: US 12,687,367 B1
(45) Date of Patent: Jul. 21, 2026

(54) PROJECTILE IMPACT SIMULATION DEVICE

(71) Applicant: Virtra, Inc., Tempe, AZ (US)

(72) Inventors: Robert D. Ferris, Mesa, AZ (US); John B. Kinnard, Mesa, AZ (US)

(73) Assignee: Virtra, Inc., Tempe, AZ (US)

( * ) Notice: Subject to any disclaimer, the term of this patent is extended or adjusted under 35 U.S.C. 154(b) by 1178 days.

(21) Appl. No.: 17/569,403

(22) Filed: Jan. 5, 2022

(51) Int. Cl.
*F41A 3/00* (2006.01)
*F41A 33/00* (2006.01)
*F41H 13/00* (2006.01)

(52) U.S. Cl.
CPC ..... *F41A 33/00* (2013.01); *F41H 13/0018* (2013.01)

(58) Field of Classification Search
CPC ..... A24F 40/40; A61B 2017/007342; A61B 18/1226; A61F 2002/702; A61F 2002/768; A61F 2007/008; A61F 2007/0078; A63B 21/0054; A63B 2021/0054; B29C 66/8618; B29L 2031/7146; B60Y 2300/91; B62J 6/003; F21S 9/02; G01J 5/028; G06L 19/0702; F41H 13/0018; A01K 27/009; A01K 15/021; A01K 15/023; A01K 15/022; A01K 15/02; F41A 33/06; F41A 33/00; F41A 33/02; F41B 15/04; G09B 9/003; G09B 9/006; H05C 1/04; H05C 1/06;
(Continued)

(56) References Cited

U.S. PATENT DOCUMENTS 679,542 A * 7/1901 Peats ..... G09F 15/0018 24/346
2,731,975 A 1/1956 Boals
(Continued)

FOREIGN PATENT DOCUMENTS

DE 102013225966 6/2015
DE 102015211619 A1 12/2016
(Continued)

OTHER PUBLICATIONS

Military Recoil Weapons and Conversion Kits https://www.lasershot.com/item/158-recoil-conversion-kits.
(Continued)

*Primary Examiner* — Kang Hu
*Assistant Examiner* — Anthony James Bulthuis
(74) *Attorney, Agent, or Firm* — Kenneth C. Booth; Booth Udall, PLC

(57) ABSTRACT

A projectile impact simulation device comprising a housing, a mounting attachment, at least two high-voltage pins, and a shock zone. The housing has a circuit board electrically coupled to high-voltage receptacles that are configured to receive a first end of a high-voltage pin. The housing also has a back surface configured to rest adjacent to a user when the user wears the device. The mounting attachment is coupled to the back surface and configured to couple the device to the user. The high-voltage pins are embedded within the housing and configured to couple with the high-voltage receptacles. Two contact pads exposed on the back surface each have an electrical contact coupled with the high-voltage pins. When a voltage differential is applied across the contact pads, the device is configured to cause an electric arc in the shock zone. When the device is worn by a user, the electric arc shocks the user.

20 Claims, 10 Drawing Sheets

(58) Field of Classification Search
CPC ..... H05C 1/00; Y10S 119/908; H01R 12/58; H01R 13/04; H01R 13/20; H01R 13/2421; H01R 13/6278; H01R 13/02; A61N 1/38; G01R 1/06722
See application file for complete search history.

(56) References Cited

U.S. PATENT DOCUMENTS

| | | | | |
|---|---|---|---|---|
| 3,834,413 | A | 9/1974 | Peterson | |
| 4,171,708 | A | 10/1979 | Pareja | |
| 5,818,354 | A * | 10/1998 | Gentry | A01K 11/006 340/539.1 |
| 7,032,611 | B1 | 4/2006 | Sheng | |
| 7,334,598 | B1 | 2/2008 | Hollars | |
| 7,975,714 | B2 | 7/2011 | Newman | |
| 8,016,594 | B2 | 9/2011 | Ferris | |
| 8,267,691 | B1 | 9/2012 | Ferris | |
| 8,827,706 | B2 | 9/2014 | Hogan, Jr. | |
| 8,894,412 | B1 * | 11/2014 | Malin | F41A 33/06 434/22 |
| 9,310,812 | B2 | 4/2016 | Costle | |
| 10,436,539 | B2 | 10/2019 | Tiberius | |
| 11,959,719 | B2 | 4/2024 | Dvorak | |
| 12,345,497 | B1 | 7/2025 | Clark | |
| 2004/0025943 | A1 | 2/2004 | Wilson | |
| 2004/0053539 | A1 * | 3/2004 | Watanabe | G01R 1/045 439/700 |
| 2005/0040633 | A1 | 2/2005 | Butler | |
| 2005/0115613 | A1 | 6/2005 | Wilson, Jr. | |
| 2006/0027225 | A1 | 2/2006 | Homsky | |
| 2006/0105299 | A1 | 5/2006 | Ferris | |
| 2006/0121419 | A1 | 6/2006 | Ferris | |
| 2007/0183115 | A1 * | 8/2007 | Myers | F41H 13/0018 361/232 |
| 2007/0186871 | A1 * | 8/2007 | Boyd | A01K 15/021 119/859 |
| 2009/0084015 | A1 | 4/2009 | Compton | |
| 2012/0129136 | A1 | 5/2012 | Dvorak | |
| 2014/0196267 | A1 | 7/2014 | Tiberius | |
| 2017/0176127 | A1 | 6/2017 | Ferris | |
| 2017/0372632 | A1 | 12/2017 | Baker | |
| 2018/0087860 | A1 | 3/2018 | Sullivan | |
| 2018/0180377 | A1 | 6/2018 | Lort | |
| 2018/0356175 | A1 | 12/2018 | Lamons | |
| 2021/0348720 | A1 | 11/2021 | Dvorak | |
| 2021/0364254 | A1 * | 11/2021 | Riedesser | F41A 33/02 |
| 2021/0366305 | A1 * | 11/2021 | Quail | H05K 5/0247 |
| 2022/0074694 | A1 | 3/2022 | Dvorak | |

FOREIGN PATENT DOCUMENTS

| | | |
|---|---|---|
| DE | 102015211621 | 12/2016 |
| EP | 3296680 | 3/2018 |
| KR | 102093831 B1 | 3/2020 |

OTHER PUBLICATIONS

Tomas Lukac, Roman Vitek, Linh Do Duc, Vladimir Horak, Experimental Mechanical Device for Recoil Simulation, Scientific Research and Education in the Air Force-AFASES, pp. 337-344, 2016, Czech Republic.

* cited by examiner

PROJECTILE IMPACT SIMULATION DEVICE

TECHNICAL FIELD

Aspects of this document relate generally to a projectile impact simulation device, and more specifically to a simulation device configured to deliver an electrical impulse to a user simulating the impact of a projectile on the user.

BACKGROUND

There is a need for effective training for law enforcement, security officers, and the military. One aspect of effective training that is lacking is training to make rapid decisions while under the threat of serious injury, such as when threatened by an individual with a firearm or other weapon. Simulation systems have been used to conduct such training exercises. For example, a shoot-back cannon has been used to discharge nylon balls at high velocity toward a trainee, with the nylon balls simulating bullets. However, the presence of physical projectiles to simulate bullets introduces safety hazards to all present and requires additional precautions. These precautions can interrupt the training activity and interfere with the effectiveness of the simulation system.

SUMMARY

Aspects of this document relate a projectile impact simulation device that may comprise a front housing having a circuit board and at least two conductive, high-voltage receptacles each electrically coupled to the circuit board and configured to receive a first end of a high-voltage pin therein, a rear housing coupled to the front housing and having a back surface distal to the front housing, the back surface configured to rest adjacent to the body of a user when the user wears the projectile impact simulation device, a mounting attachment coupled to the back surface of the rear housing and configured to directly couple the projectile impact simulation device to the user or an article of clothing worn by the user, at least two high-voltage pins embedded within the rear housing and configured to mateably couple with the at least two high-voltage receptacles, each of the at least two high-voltage pins having a head with a convex contact surface, and a shock zone on the back surface of the rear housing comprising the area between at least two contact pads, the at least two contact pads exposed on the back surface of the rear housing and each having an electrical contact extending into the rear housing configured to maintain contact with the convex contact surface of the head of a respective high-voltage pin of the at least two high-voltage pins, wherein when a voltage differential is applied across the at least two high-voltage pins, the voltage differential is carried to the at least two contact pads and wherein the projectile impact simulation device is configured to deliver a maximum shock having an average current of less than 500 milliamps (mA) through plurality of charge pulses in the shock zone to the at least two contact pads, and wherein when the projectile impact simulation device is worn by the user, the projectile impact simulation device is configured to deliver an electric shock to the user through any clothing positioned between the projectile impact simulation device and skin of the user as a simulation of a projectile impact.

Particular embodiments may include one or more of the following features. The mounting attachment may be at least one of a clip configured to slide onto and grip an article of clothing and a loop configured to receive and be supported by a band. The band may have a hole and the mounting attachment has a projection configured to extend through the hole when the band extends through the loop. A control switch may be configured to select a desired shock delivery time from among at least one of 1 second, 750 milliseconds (ms), 500 ms, and 250 ms. The average current may be less than 500 mA is an average current less than 300 mA.

Aspects of this document also relate to a projectile impact simulation device that may comprise a housing having a circuit board, at least two conductive, high-voltage receptacles each electrically coupled to the circuit board, and a back surface configured to rest adjacent to the body of a user when the user wears the projectile impact simulation device, at least two high-voltage pins embedded within the housing and coupled with the at least two high-voltage receptacles, and a shock zone on the back surface of the housing comprising the area between at least two contact pads, the at least two contact pads exposed on the back surface of the housing and each having an electrical contact extending into the housing configured to maintain contact with a respective high-voltage pin of the at least two high-voltage pins, wherein when a voltage differential is applied across the at least two high-voltage pins, the voltage differential is carried to the at least two contact pads, and wherein the projectile impact simulation device is configured to deliver an electric shock having a maximum average current of less than 500 milliamps (mA) through plurality of charge pulses in the shock zone to the at least two contact pads, and wherein when the projectile impact simulation device is worn by the user, the projectile impact simulation device is configured to deliver the electric shock to the user as a simulation of a projectile impact.

Particular embodiments may include one or more of the following features. A control switch may be configured to select a desired shock delivery time from among at least one of 1 second, 750 milliseconds (ms), 500 ms, and 250 ms. The average current may be less than 500 mA is an average current less than 300 mA. Each of the at least two high-voltage pins may include a head with a convex contact surface. Each of the electrical contacts may be configured to maintain contact with the convex contact surface of the head of a respective high-voltage pin of the at least two high-voltage pins.

Aspects of this document also relate to a projectile impact simulation device that may comprise a housing having a back surface configured to rest adjacent the body of a user when the user wears the projectile impact simulation device, and a shock zone on the back surface of the housing comprising an area between at least two contact pads, the at least two contact pads exposed on the back surface of the housing and each having an electrical contact extending into a rear housing configured to maintain contact with each of at least two high-voltage pins, wherein when a voltage differential is applied across the at least two high-voltage pins, the voltage differential is carried to the at least two contact pads and wherein the projectile impact simulation device is configured to deliver an electric shock having a maximum average current of less than 750 milliamps (mA) through plurality of charge pulses in the shock zone to the at least two contact pads, and wherein when the projectile impact simulation device is worn by the user, the projectile impact simulation device is configured to deliver the electric shock to the user as a simulation of a projectile impact.

Particular embodiments may include one or more of the following features. The housing may further have at least two conductive, high-voltage receptacles each electrically coupled to a power source. The at least two high-voltage pins may be configured to mateably couple with the at least two high-voltage receptacles. A mounting attachment may be to the back surface of the housing and configured to directly couple the projectile impact simulation device to the user or an article of clothing worn by the user. The mounting attachment may have a plurality of stabilization ribs configured to grip the article of clothing of the user. A length of each of the at least two contact pads may extend over a majority of a length of the back surface of the rear housing. Each of the at least two high-voltage pins may have a head with a convex contact surface. Each of the electrical contacts may be configured to maintain contact with the convex contact surface of the head of a respective high-voltage pin of the at least two high-voltage pins. A control switch may be configured to select a desired shock delivery time from among at least one of 1 second, 750 milliseconds (ms), 500 ms, and 250 ms. The average current may be less than 750 mA is an average current less than 400 mA.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
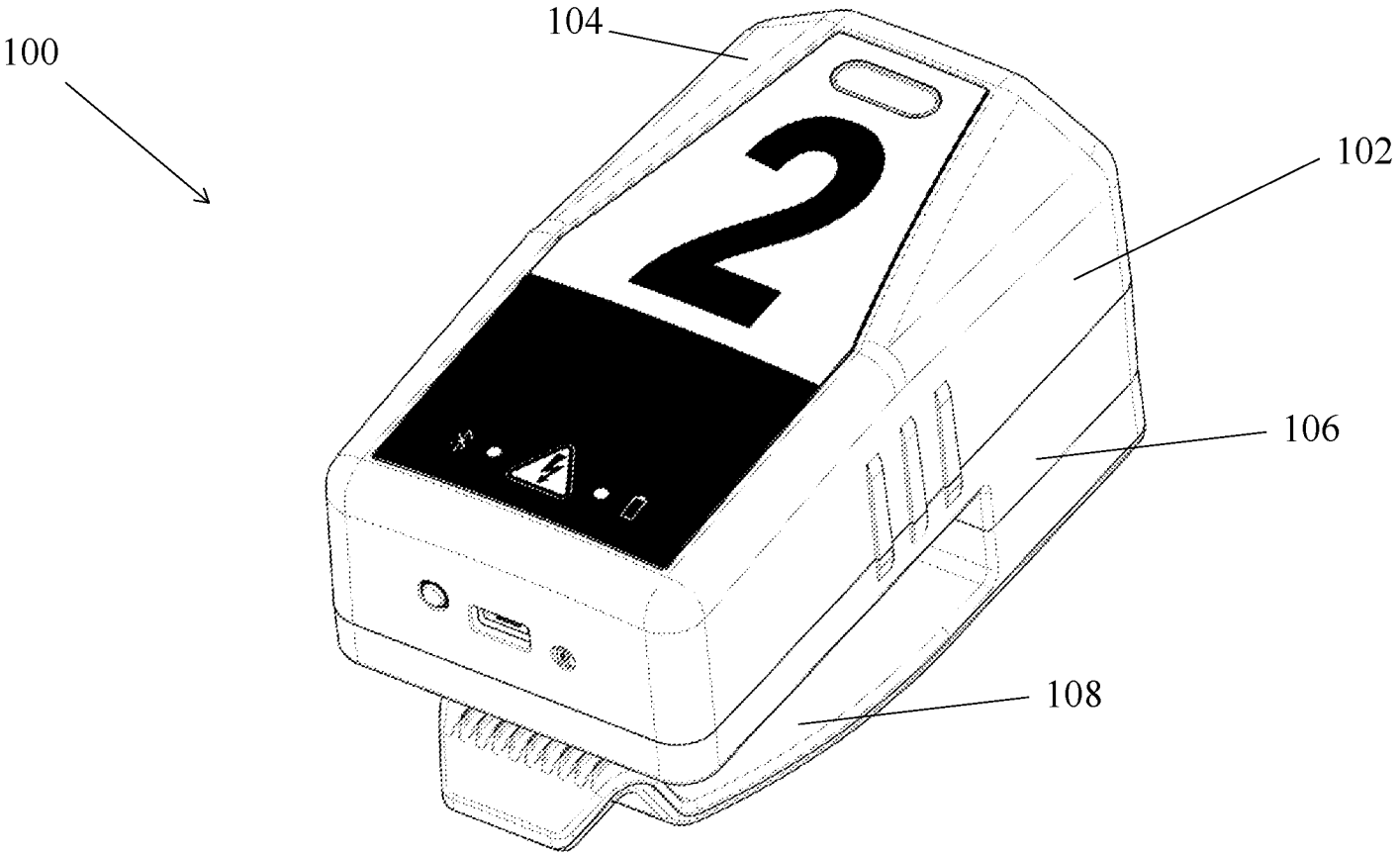
FIG. 1 is a perspective view of a projectile impact simulation device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure concerns a projectile impact simulation device 100 intended to be used as part of a training program which simulates situations in which dangerous projectiles such as bullets and shrapnel may impact an individual. In place of launching physical projectiles, the projectile impact simulation device 100 is placed adjacent to a trainee's body, in some cases separated from the trainee's skin only by a layer of clothing, and an electric shock is delivered to the trainee's body through the clothing as a simulation of the impact of a projectile. An example of such a system is found in U.S. Pat. No. 8,267,691 entitled "Threat fire simulation and training system" to Ferris et al., the disclosure of which is hereby incorporated herein by this reference. There are challenges in using electric shock. First, when using electric shock there is a safety need to limit the current supplied to a safe level. Second, high-voltage will internally arc, unless inventive methods are undertaken to avoid the damaging electric arcing. Lastly, in a real-life scenario, just the initial pain is not as realistic as if there is an initial pain from the shot followed by incapacitation of the limb that has been shot. In this way, both the pain of impact and the loss of function is simulated for the trainee during their training exercise so as to properly practice for a potential real-world encounter.

Figure 2:
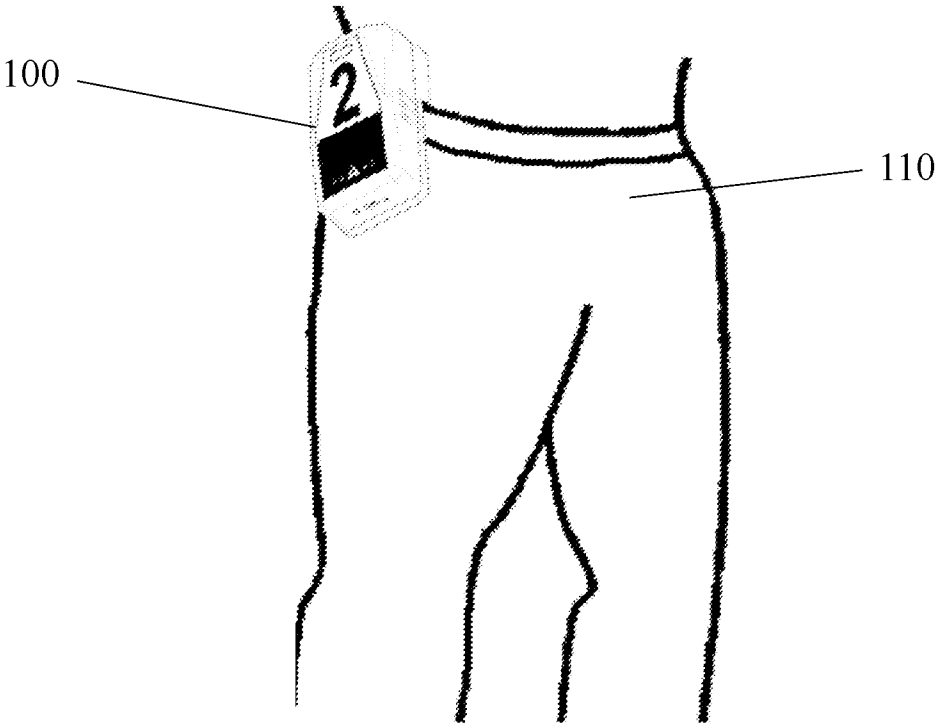
FIG. 2 is a view of the projectile impact simulation device from FIG. 1 being worn on a user's waist.
Figure 3:
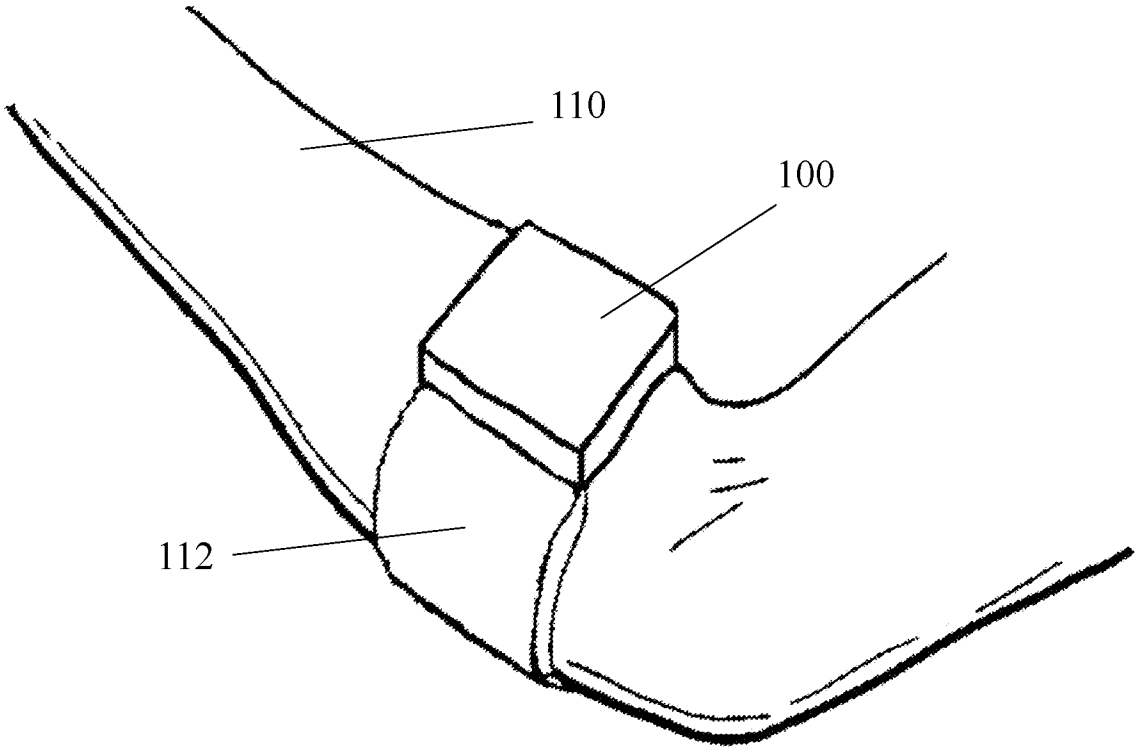
FIG. 3 is a view of the projectile impact simulation device from FIG. 1 being worn on a user's arm.

FIG. 1 illustrates an embodiment of the projectile impact simulation device 100. The projectile impact simulation device 100 has a housing 102, which may be formed having a front housing 104 and a rear housing 106, with the rear housing 106 coupled to the front housing 104. The projectile impact simulation device 100 may also have a mounting attachment 108. The mounting attachment 108 is coupled to the housing 102 and is configured to couple the projectile impact simulation device 100 directly to a user 110 or to an article of clothing worn by the user 110. For example, as shown in FIG. 2, the projectile impact simulation device 100 may be coupled with a belt worn by the user 110, or, as shown in FIG. 3, the projectile impact simulation device 100 may have a band 112 which directly couples the projectile impact simulation device 100 to a body part of the user 110, such as a leg, an arm, a back, or other body part.

Figure 4:
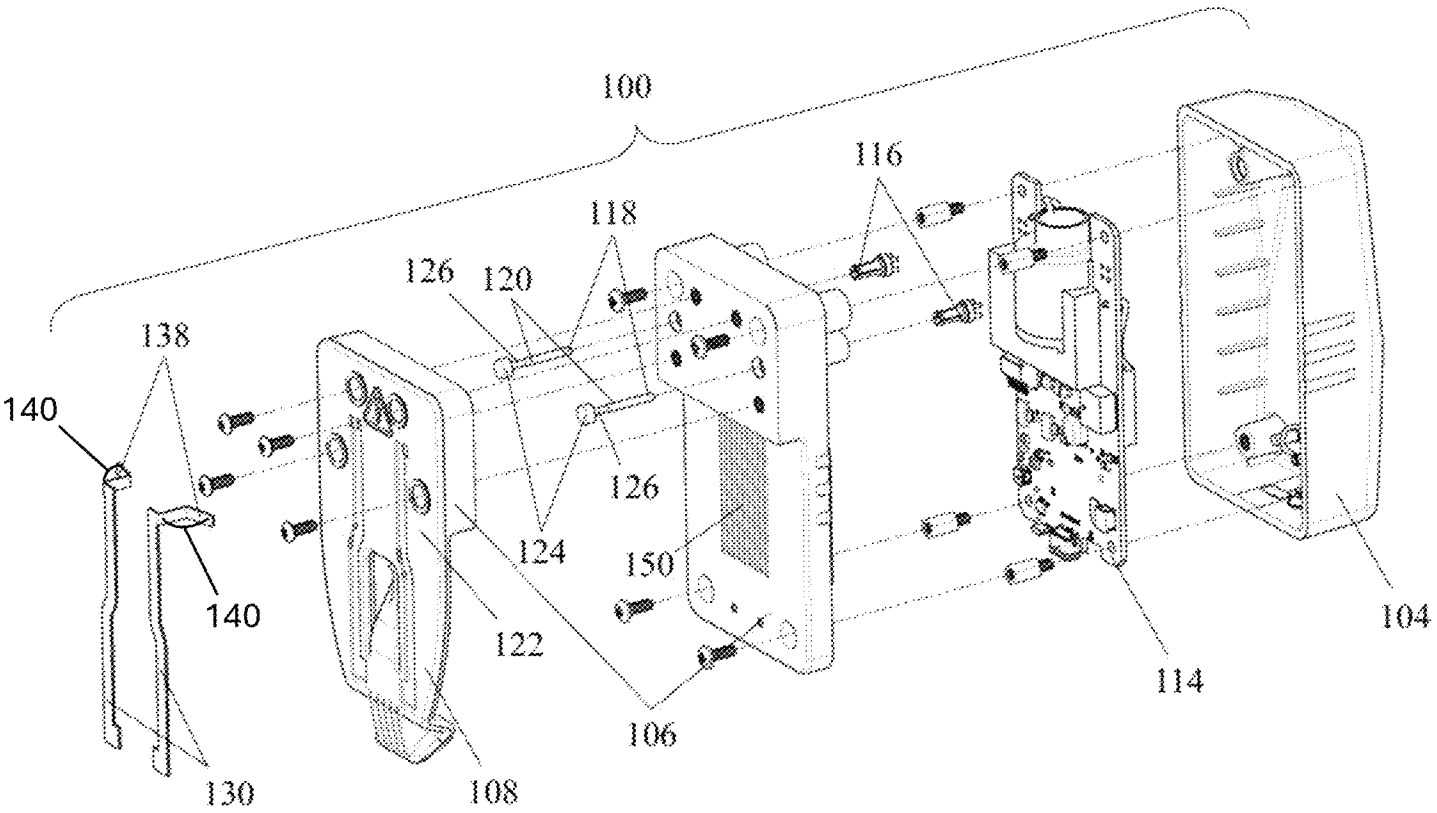
FIG. 4 is an exploded view of the projectile impact simulation device from FIG. 1.

FIG. 4 illustrates an exploded view of the components of the projectile impact simulation device 100. The front housing 104 has a circuit board 114 and at least two high-voltage receptacles 116. The high-voltage receptacles 116 are each made of a conductive material and are electrically coupled to the circuit board 114. In addition, the high-voltage receptacles 116 are configured to receive a first end 118 of a high-voltage pin 120. The circuit board 114 is configured to apply a voltage differential across the high-voltage receptacles 116. The rear housing 106 is configured to couple with the front housing 104. The rear housing 106 has a back surface 122 distal to the front housing 104. The back surface 122 is configured to rest adjacent to the body of the user 110, separated from the user's skin by a layer of clothing or no layer of clothing, when the user 110 wears the projectile impact simulation device 100. The mounting attachment 108 may be coupled to the back surface 122 of the housing 102.

The projectile impact simulation device 100 has at least two high-voltage pins 120 embedded within the housing 102. In embodiments with a front housing 104 and a rear housing 106, the high-voltage pins 120 may be embedded within the rear housing 106. The high-voltage pins 120 are made of a conductive material and are configured to mateably couple with the high-voltage receptacles 116. The high-voltage pins 120 include a head 124 on a second end 126 of the high-voltage pins 120. The head 124 may have a convex contact surface 128 (see FIG. 6), to encourage more consistent contact with the electrical contacts 138.

Figure 5:
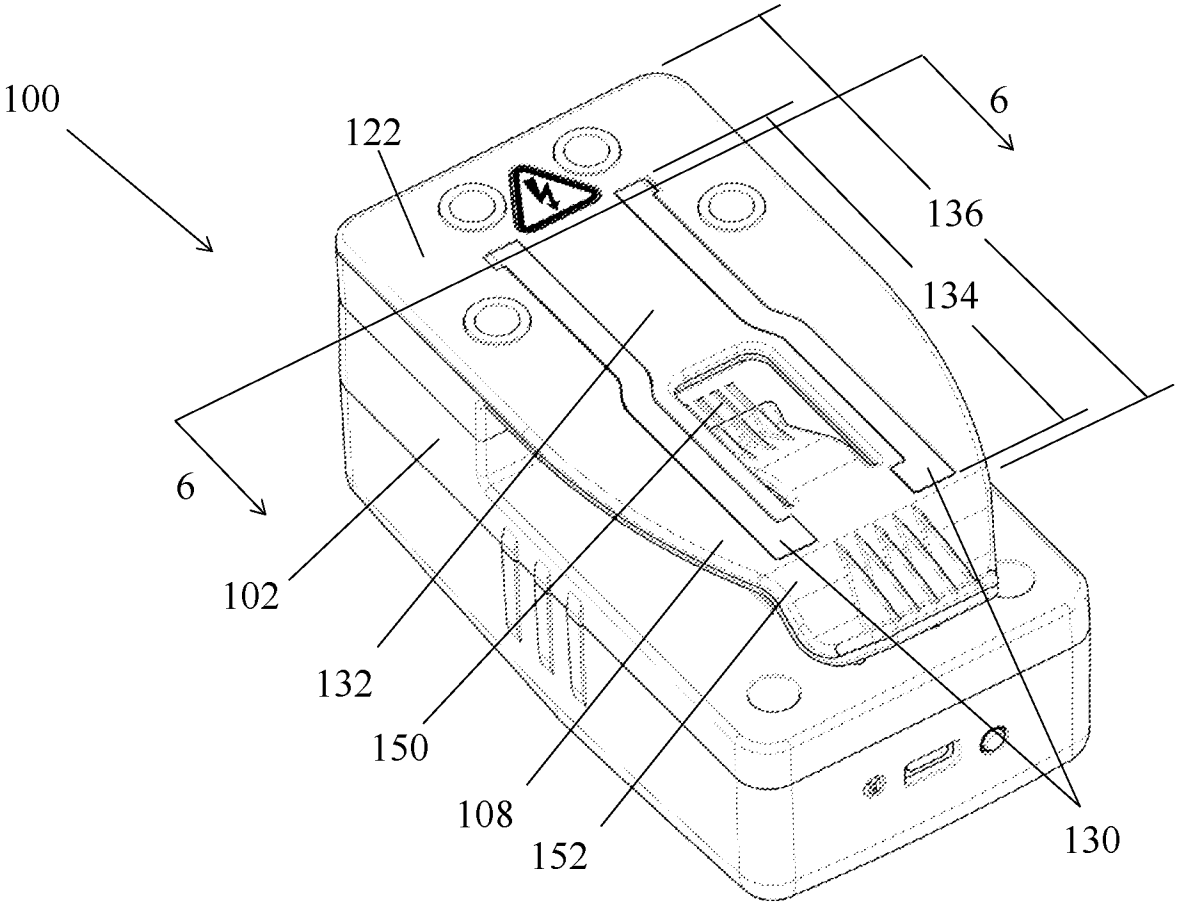
FIG. 5 is a perspective back view of the projectile impact simulation device from FIG. 1.

As shown in FIG. 5, the projectile impact simulation device 100 includes at least two pads 130 and a shock zone 132 on the back surface 122. The pads 130 are exposed on the back surface 122 of the housing 102 and the shock zone 132 comprises the area between the pads 130. The pads 130 each have a first length 134 and the back surface 122 of the housing 102 has a second length 136. In particular embodiments, the first length 134 extends over a majority of the second length 136. Alternatively, in other embodiments, the first length 134 may extend over less than half of the second length 136 (see FIG. 10). Each pad 130 is made of a conductive material and has an electrical contact 138 extending into the housing 102, as shown in FIGS. 6-7.

The electrical contact 138 is configured to maintain contact with the convex contact surface 128 of the head 124 of a high-voltage pin 120. The shape of the convex contact surface 128 may be configured to facilitate maintaining an electrical connection between the high-voltage pin 120 and the pad 130. For example, the slightly curved shape of the convex contact surface 128 shown in FIG. 6 allows the electrical contact 138 to maintain the electrical connection at a number of angles. Before the high-voltage pins 120 are placed in contact with the electrical contacts 138, the electrical contacts 138 are positioned to extend into the housing 102 at a first angle 140 (as shown in FIG. 4). Once installed, the high-voltage pins 120 may be configured to press against the electrical contacts 138 and cause the electrical contacts 138 to flex to a second angle 142. Thus, the resistance to flex of the electrical contacts 138 creates a stronger electrical connection between the high-voltage pins 120 and the electrical contacts 138 because the two components push against each other. In combination with the shape of the convex contact surface 128, this creates a better electrical connection than would otherwise exist between the high-voltage pins 120 and the pads 130.

Figure 6:
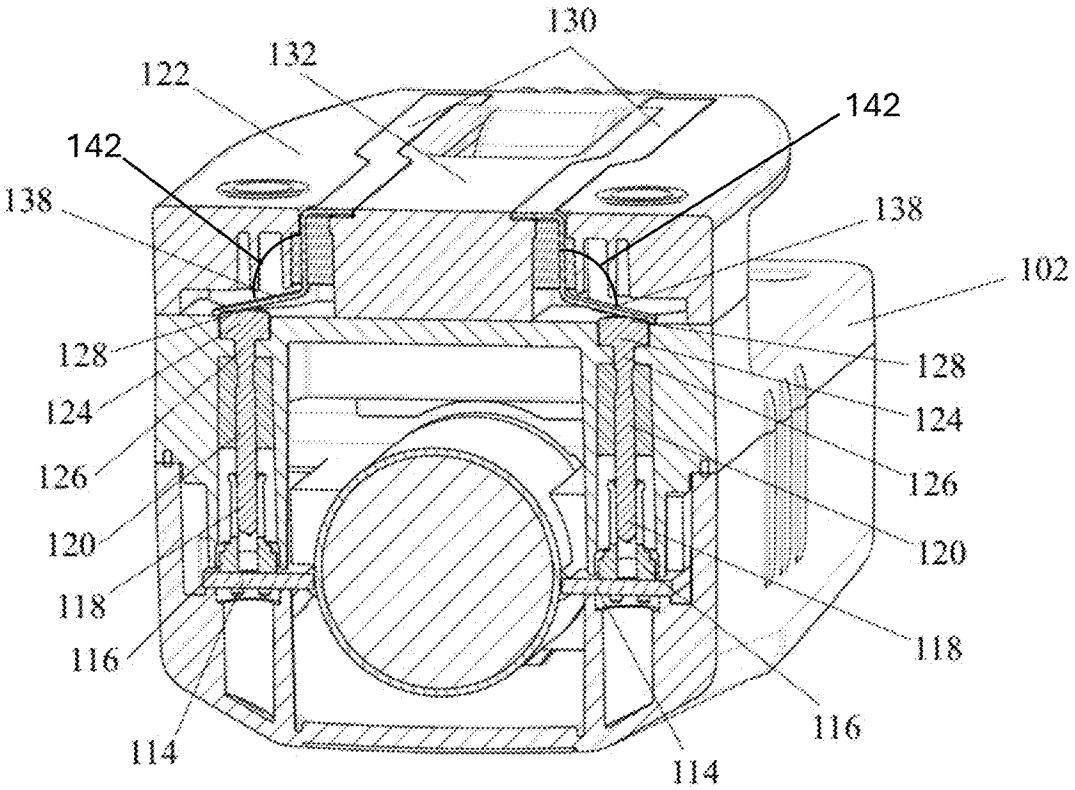
FIG. 6 is a cross section of the projectile impact simulation device from FIG. 5, taken along line 6-6.
Figure 7:
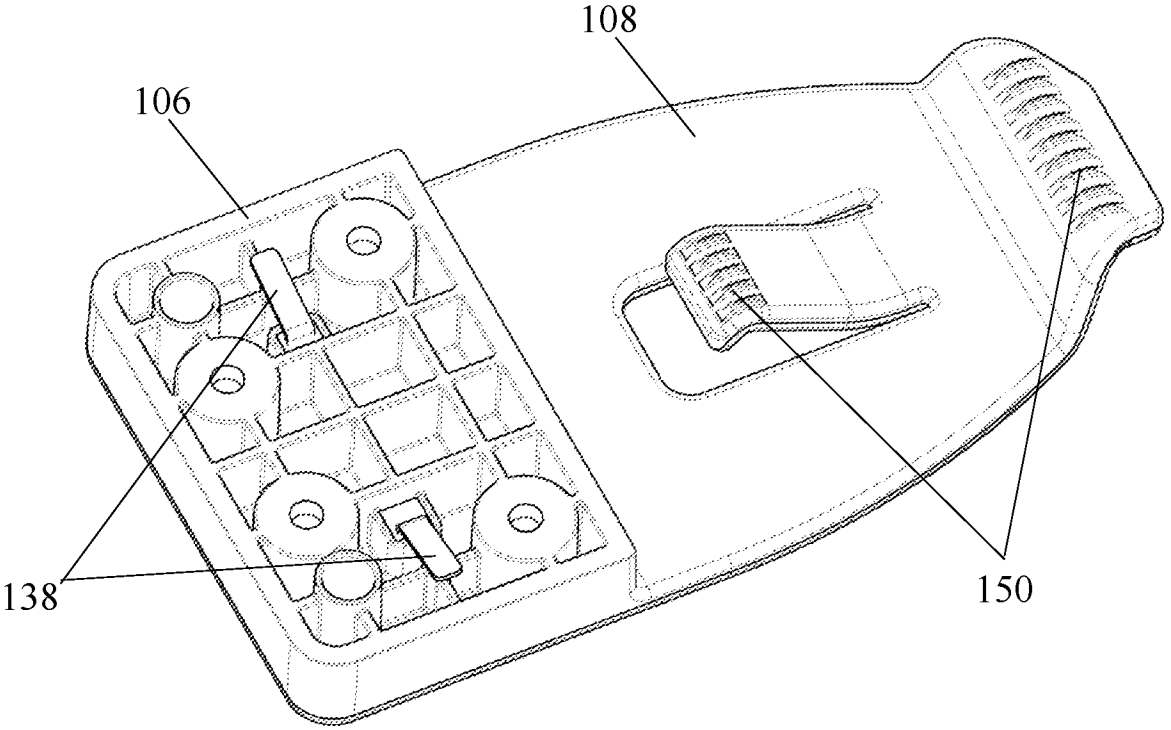
FIG. 7 is a perspective view of the mounting attachment with the electrical contacts of the at least two pads extending into the housing.

FIG. 6 illustrates the components described above fitted together within the housing 102. As shown, when the circuit board 114 applies a voltage differential across the high-voltage receptacles 116, the voltage differential is transferred from the conductive, high-voltage receptacles 116 to the conductive, high-voltage pins 120 and from the conductive, high-voltage pins 120 to the conductive pads 130 through the electrical contacts 138. The projectile impact simulation device 100 is configured to cause an electric arc across the shock zone 132 between the at least two pads 130 by extending and applying the voltage differential across the pads 130. When the projectile impact simulation device 100 is worn by the user 110, this electric arc delivers an electric shock to the user 110 as a simulation of a projectile impact.

Generally, the voltage differential across the conductive pads 130 is a high voltage so that the electric shock can be felt by the user 110 through clothing. However, controls are put into place to ensure the shock is completely delivered within a short amount of time with a low average current to ensure the safety of the user 110 despite the initial pain. When a shock is delivered, the shock is delivered as a series of pulses released within a set time, such as one second, at a predetermined voltage, with charge per pulse, and a pulse width. The result of this type of a shock release is an average current released per shock. Particular embodiments may be configured with pre-set pulse voltage, pulse charge, pulse frequency and pulse width, so that the user or the control system need only control the duration of the shock delivery, and the maximum average current released is limited to a safe level. For example, with a conductive pads 130 spacing of 20 millimeters (mm), a charge per pulse of 7.15 microcoulombs, a pulse width of 25 microseconds, and delivering 8 pulses within 1 second (frequency of 8 Hz), the average current released is 286 milliamps (mA). This is significantly different from a Taser® or typical stun gun that emit a shock at a much higher average current of over 1000 mA per shock delivered. In some stun guns, the current per pulse may be low, such as 1-4 mA, the shock releases at a much higher frequency (kHz range), and for a longer duration, resulting in a much higher average current released per shock, and the cumulative current released incapacitates the recipient of the shock.

For the projectile impact simulation device 100, a lower average current per shock is released to allow the electric shock to be felt by the user 110 but limit some of the negative effects of the electric shock and extend a level of safety to the user. A typical shock delivered through the projectile impact simulation device disclosed herein is delivered in less than 1 second, though longer and shorter shock duration times are contemplated for particular applications. For example, in a second embodiment, the shock is delivered within 750 milliseconds (ms) or less. In a third embodiment, the shock is delivered within 500 ms or less. In a fourth embodiment, the shock is delivered within 250 ms or less. In another embodiment, the user has an option through a control switch either physically on the unit or programmatically included within the unit, to select the desired shock delivery time, selecting between 1 second, 750 ms, 500 ms, and 250 ms for a previously configured pulse charge, frequency and width associated with the shock. From the pulse charge, width, frequency and duration, the average current for the shock can be calculated.

In particular embodiments, the projectile impact simulation device 100 may be configured to deliver a maximum average shock of less than 750 milliamps per shock. In other particular embodiments, the projectile impact simulation device is configured to deliver a maximum average shock of less than 500 milliamps per shock. In still other particular embodiments, the projectile impact simulation device is configured to deliver a maximum average shock of less than 400 milliamps per shock. And in still other particular embodiments, the projectile impact simulation device is configured to deliver a maximum average shock of less than 300 milliamps per shock. By delivering a lower average current per shock, the user is not immobilized or incapacitated, but can still feel pain from the shock delivered.

The effect of a projectile impact on the user 110 is thus simulated, because the electric shock acts as the initial impact and the area of the body affected by the electric shock, such as the hip if the projectile impact simulation device 100 is worn around the waist, may continue to ache for a period of time after the application of the electric shock. Users 110 can thus learn to make decisions under the threat of physical pain during a training program without any real harm being done. U.S. Pat. No. 8,267,691, previously incorporated herein by reference, provides examples of shock voltages typical for this type of system.

Figure 8:
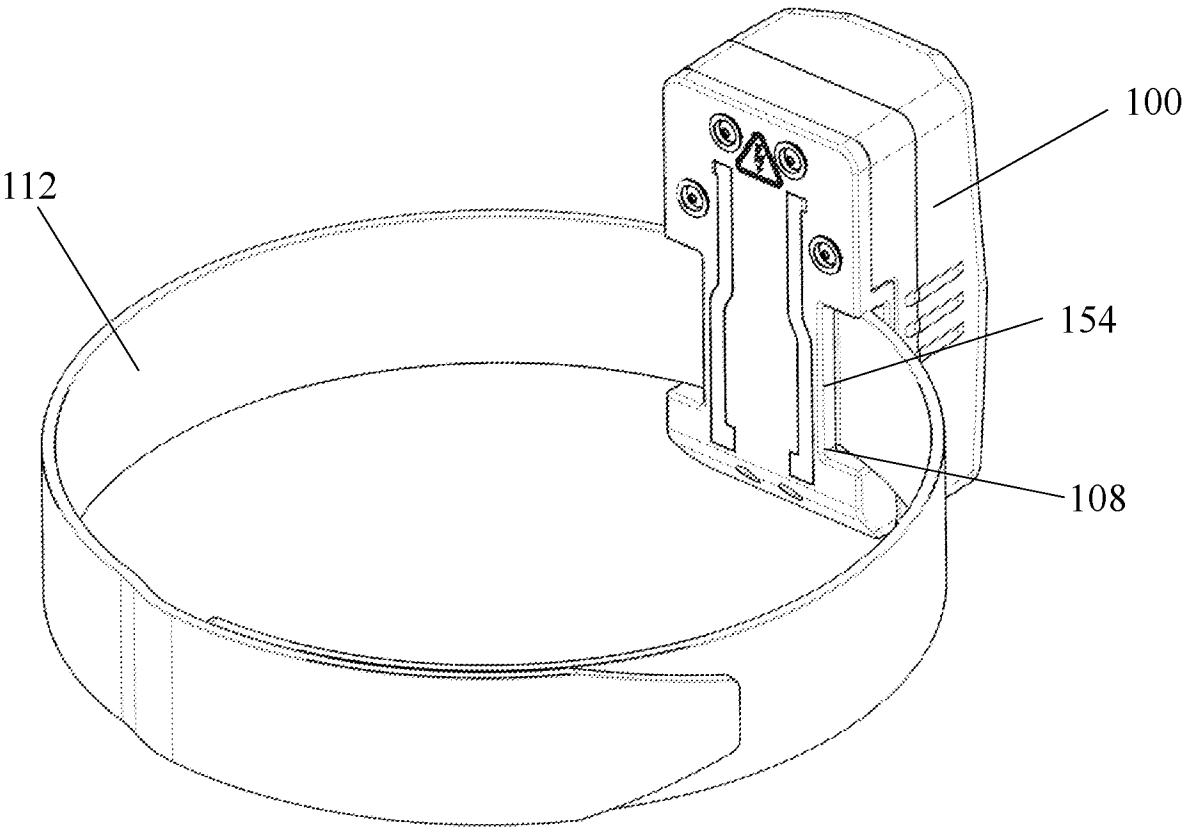
FIG. 8 is a perspective view of an embodiment of the projectile impact simulation device with a band loop and attached to a band.
Figure 9:
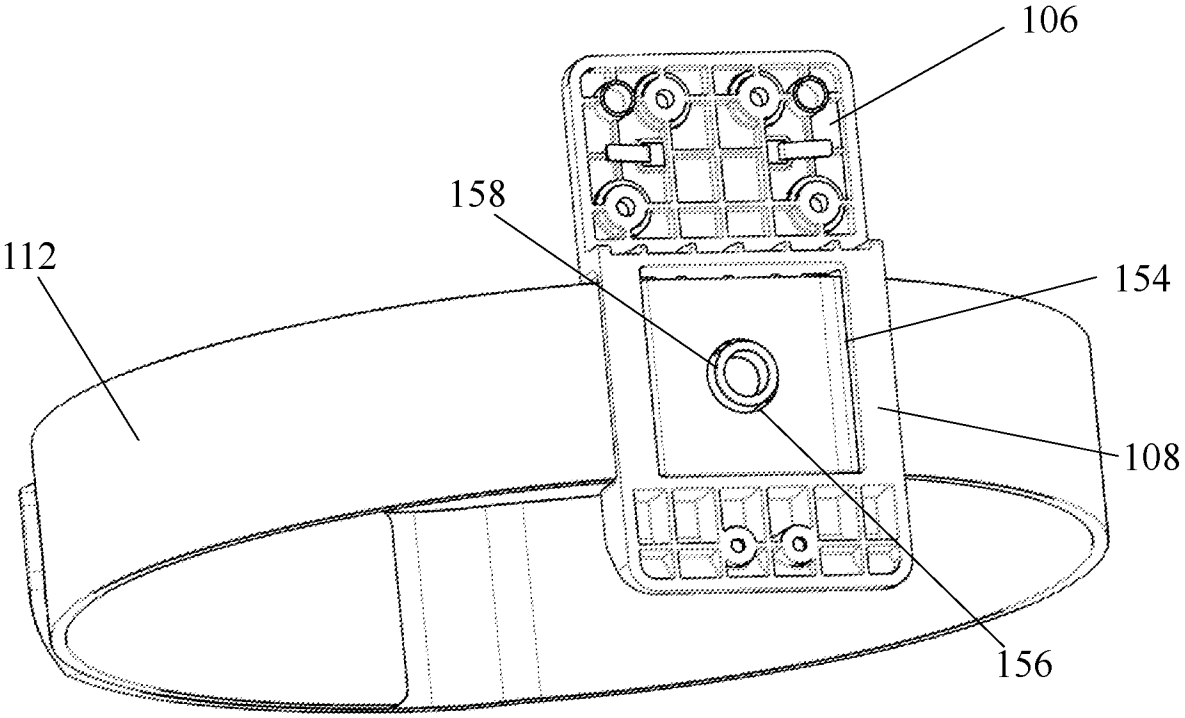
FIG. 9 is a perspective view of an embodiment of the projectile impact simulation device with a projection configured to extend through a hole in the band.

The mounting attachment 108 may have a plurality of stabilization ribs 150 (see FIGS. 4-5, 7). The stabilization ribs 150 are configured to grip the article of clothing worn by the user 110. The stabilization ribs 150 thus provide stability to the projectile impact simulation device 100 and help to keep the projectile impact simulation device 100 in place during use. Different embodiments of the mounting attachment 108 are shown in FIGS. 5 and 8-10. For example, the mounting attachment 108 may be a clip 152, as shown in FIG. 5. The clip 152 is configured to slide onto and grip an article of clothing such as a belt or the waist of a pair of pants. Alternatively, the mounting attachment 108 may be a loop 154 configured to receive and be supported by a band 112, such as a belt or a strap, as shown in FIGS. 8-9. The band 112 may be made of an elastic material.

Figure 10:
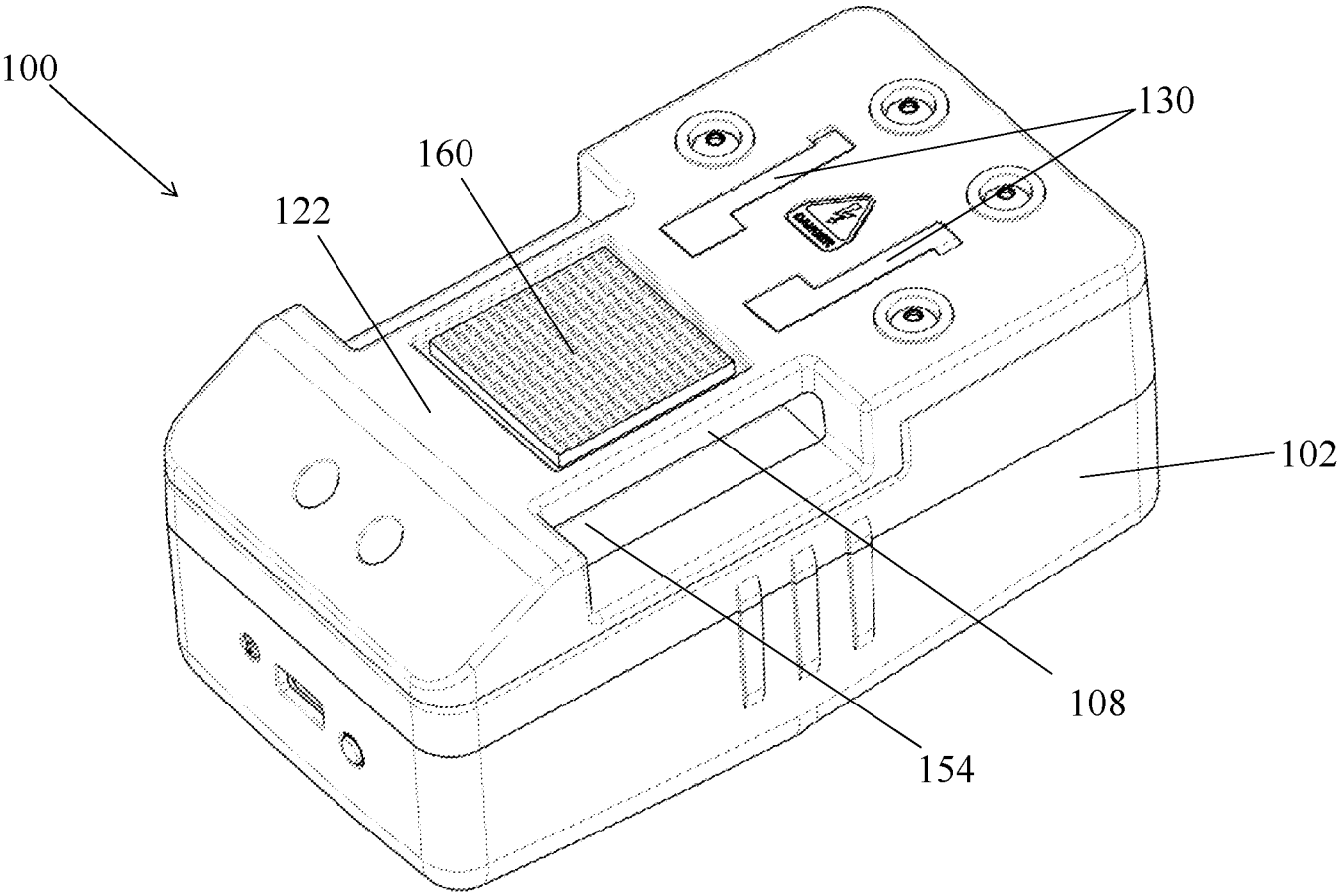
FIG. 10 is a perspective view of an embodiment of the projectile impact simulation device with a hook and loop fastener.

Any fastener may be used to allow the band 112 to attach to itself or to the user 110. For example, a buckle, a snap, or a hook and loop material may be used. Alternatively, the band 112 may not have ends, and instead may be made of an elastic material that allows the band 112 to be placed on a limb or around the waist by stretching the band 112 around the body of the user 110. FIG. 9 illustrates an embodiment of the mounting attachment 108 where the band 112 has a hole 156 and the mounting attachment 108 has a projection 158 that is configured to extend through the hole 156 when the band 112 extends through the loop 154. The projection 158 provides additional stability to the projectile impact simulation device 100 by limiting the movement of the projectile impact simulation device 100 on the band 112. FIG. 10 illustrates the mounting attachment 108 as a hook and loop material 160 attached to the back surface 122 of the housing 102.

It will be understood that implementations of a projectile impact simulation device are not limited to the specific assemblies, devices and components disclosed in this document, as virtually any assemblies, devices and components consistent with the intended operation of a projectile impact simulation device may be used. Accordingly, for example, although particular projectile impact simulation devices, and other assemblies, devices and components are disclosed, such may include any shape, size, style, type, model, version, class, measurement, concentration, material, weight, quantity, and/or the like consistent with the intended operation of projectile impact simulation devices. Implementations are not limited to uses of any specific assemblies, devices and components; provided that the assemblies, devices and components selected are consistent with the intended operation of a projectile impact simulation device.

Accordingly, the components defining any projectile impact simulation device implementations may be formed of any of many different types of materials or combinations thereof that can readily be formed into shaped objects provided that the components selected are consistent with the intended operation of a projectile impact simulation device implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various projectile impact simulation devices may be manufactured using conventional procedures as added to and improved upon through the procedures described here. Some components defining a projectile impact simulation device may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that projectile impact simulation devices are not limited to the specific order of steps as disclosed in this document. Any steps or sequence of steps of the assembly of a projectile impact simulation device indicated herein are given as examples of possible steps or sequence of steps and not as limitations, since various assembly processes and sequences of steps may be used to assemble projectile impact simulation devices.

The implementations of a projectile impact simulation device described are by way of example or explanation and not by way of limitation. Rather, any description relating to the foregoing is for the exemplary purposes of this disclosure, and implementations may also be used with similar results for a variety of other applications employing a projectile impact simulation device.

What is claimed is:

1. A projectile impact simulation device, comprising:

a front housing having a circuit board and at least two conductive, high-voltage receptacles each electrically coupled to the circuit board and configured to receive a first end of a high-voltage pin therein;

a rear housing coupled to the front housing and having a back surface distal to the front housing, the back surface configured to rest adjacent to the body of a user when the user wears the projectile impact simulation device;

a mounting attachment coupled to the back surface of the rear housing and configured to directly couple the projectile impact simulation device to the user or an article of clothing worn by the user;

at least two high-voltage pins embedded within the rear housing and configured to mateably couple with the at least two high-voltage receptacles, each of the at least two high-voltage pins having a head with a convex contact surface; and a shock zone on the back surface of the rear housing comprising the area between at least two contact pads, the at least two contact pads exposed on the back surface of the rear housing and each of the at least two contact pads having an electrical contact extending into the rear housing, each electrical contact comprising a first portion extending in a first direction and a second portion extending from the first portion in a second direction different from the first direction such that when the second portion contacts the convex contact surface of a corresponding high-voltage pin of the at least two high-voltage pins, the electrical contact is configured to flex and exert a pushing force against the convex contact surface of the head of the corresponding high-voltage pin to maintain contact with the convex contact surface of the head of the corresponding high-voltage pin;

wherein when a voltage differential is applied across the at least two high-voltage pins, the voltage differential is carried to the at least two contact pads and wherein the projectile impact simulation device is configured to deliver a maximum shock having an average current of less than 500 milliamps (mA) through plurality of charge pulses in the shock zone to the at least two contact pads; and wherein when the projectile impact simulation device is worn by the user, the projectile impact simulation device is configured to deliver an electric shock to the user through any clothing positioned between the projectile impact simulation device and skin of the user as a simulation of a projectile impact.

2. The projectile impact simulation device of claim 1, wherein the mounting attachment is at least one of a clip configured to slide onto and grip an article of clothing and a loop configured to receive and be supported by a band.

3. The projectile impact simulation device of claim 2, wherein the band has a hole and the mounting attachment has a projection configured to extend through the hole when the band extends through the loop.

4. The projectile impact simulation device of claim 1, further comprising a control switch configured to select a desired shock delivery time from among at least one of 1 second, 750 milliseconds (ms), 500 ms, and 250 ms.

5. The projectile impact simulation device of claim 1, wherein the average current less than 500 mA is an average current less than 300 mA.

6. A projectile impact simulation device, comprising:

a housing having a circuit board, at least two conductive, high-voltage receptacles each electrically coupled to the circuit board, and a back surface configured to rest adjacent to the body of a user when the user wears the projectile impact simulation device;

at least two high-voltage pins embedded within the housing and coupled with the at least two high-voltage receptacles; and a shock zone on the back surface of the housing comprising the area between at least two contact pads, the at least two contact pads exposed on the back surface of the housing and each of the at least two contact pads having an electrical contact extending into the housing, each electrical contact configured to flex from a first angle to a second angle different from the first angle when the electrical contact contacts a corresponding high-voltage pin of the at least two high-voltage pins to maintain contact with the corresponding high-voltage pin;

wherein when a voltage differential is applied across the at least two high-voltage pins, the voltage differential is carried to the at least two contact pads, and wherein the projectile impact simulation device is configured to deliver an electric shock having a maximum average current of less than 500 milliamps (mA) through plurality of charge pulses in the shock zone to the at least two contact pads; and wherein when the projectile impact simulation device is worn by the user, the projectile impact simulation device is configured to deliver the electric shock to the user as a simulation of a projectile impact.

7. The projectile impact simulation device of claim 6, further comprising a control switch configured to select a desired shock delivery time from among at least one of 1 second, 750 milliseconds (ms), 500 ms, and 250 ms.

8. The projectile impact simulation device of claim 6, wherein the average current less than 500 mA is an average current less than 300 mA.

9. The projectile impact simulation device of claim 6, wherein each of the at least two high-voltage pins has a head with a convex contact surface.

10. The projectile impact simulation device of claim 9, wherein each of the electrical contacts is configured to maintain contact with the convex contact surface of the head of the corresponding high-voltage pin of the at least two high-voltage pins.

11. A projectile impact simulation device, comprising:

a housing having a back surface configured to rest adjacent the body of a user when the user wears the projectile impact simulation device and comprising at least two high-voltage pins; and a shock zone on the back surface of the housing comprising an area between at least two contact pads, the at least two contact pads exposed on the back surface of the housing and each having an electrical contact extending into a rear housing, each electrical contact configured to flex when contacting a corresponding high-voltage pin of the at least two high-voltage pins and maintain contact with the corresponding high-voltage pin;

wherein when a voltage differential is applied across the at least two high-voltage pins, the voltage differential is carried to the at least two contact pads and wherein the projectile impact simulation device is configured to deliver an electric shock having a maximum average current of less than 750 milliamps (mA) through plurality of charge pulses in the shock zone to the at least two contact pads; and wherein when the projectile impact simulation device is worn by the user, the projectile impact simulation device is configured to deliver the electric shock to the user as a simulation of a projectile impact.

12. The projectile impact simulation device of claim 11, the housing further having at least two conductive, high-voltage receptacles each electrically coupled to a power source.

13. The projectile impact simulation device of claim 12, wherein the at least two high-voltage pins are configured to mateably couple with the at least two high-voltage receptacles.

14. The projectile impact simulation device of claim 11, further comprising a mounting attachment coupled to the back surface of the housing and configured to directly couple the projectile impact simulation device to the user or an article of clothing worn by the user.

15. The projectile impact simulation device of claim 14, wherein the mounting attachment has a plurality of stabilization ribs configured to grip the article of clothing of the user.

16. The projectile impact simulation device of claim 11, wherein a length of each of the at least two contact pads extends over a majority of a length of the back surface of the rear housing.

17. The projectile impact simulation device of claim 11, wherein each of the at least two high-voltage pins has a head with a convex contact surface.

18. The projectile impact simulation device of claim 17, wherein each of the electrical contacts is configured to maintain contact with the convex contact surface of the head of the corresponding high-voltage pin of the at least two high-voltage pins.

19. The projectile impact simulation device of claim 11, further comprising a control switch configured to select a desired shock delivery time from among at least one of 1 second, 750 milliseconds (ms), 500 ms, and 250 ms.

20. The projectile impact simulation device of claim 11, wherein the average current less than 750 mA is an average current less than 400 mA.

* * * * *